US005466187A

United States Patent [19]

Kennedy et al.

[11] Patent Number: 5,466,187

[45] Date of Patent: Nov. 14, 1995

[54] MINE VENTILATION STRUCTURE

[75] Inventors: John M. Kennedy; William R. Kennedy, both of Taylorville, Ill.

[73] Assignee: Jack Kennedy Metal Products and Buildings, Inc., Taylorville, Ill.

[21] Appl. No.: 77,128

[22] Filed: Jun. 14, 1993

Related U.S. Application Data

[63] Continuation of Ser. No. 706,036, May 28, 1991, abandoned.

[51] Int. Cl.[6] ..... E21F 1/14

[52] U.S. Cl. ..... 454/169; 405/153

[58] Field of Search ..... 52/86, 87, 332, 52/630, 484, 588, 358, 360, 713, 334; 405/151, 153; 454/168, 169

[56] References Cited

U.S. PATENT DOCUMENTS

| | | | |
|---|---|---|---|
| 1,923,008 | 8/1933 | Proctor . | |
| 2,062,160 | 11/1936 | Calkins et al. . | |
| 2,180,317 | 11/1939 | Davis . | |
| 2,238,566 | 4/1941 | Perrine . | |
| 2,264,100 | 11/1941 | Smith . | |
| 2,333,908 | 11/1943 | Wilkoff . | |
| 4,621,951 | 11/1986 | Dewson | 405/303 |

FOREIGN PATENT DOCUMENTS

| | | | |
|---|---|---|---|
| 183694 | 3/1955 | Austria | 405/153 |
| 1382333 | 1/1975 | United Kingdom | 405/153 |

*Primary Examiner*—Harold Joyce
*Attorney, Agent, or Firm*—Senniger, Powers, Leavitt & Roedel

[57] ABSTRACT

A mine ventilation structure for installation at the intersection of first and second passageways in a mine. The ventilation structure defines a first passage communicating with the first passageway and a second passage communicating with the second passageway. The ventilation structure includes a pair of generally parallel, spaced-apart side walls defining the side walls of the first passage, and a plurality of elongate deck panels extending between the side walls and forming the roof of one of the first and second passages and the floor of the other of the first and second passages. Each deck panel is a sheet metal panel generally of inverted channel shape in transverse cross section, having an upper web and side flanges extending down from the upper web at opposite sides of the web. Tie bars hold the deck panels together in fixed side-by-side relation with the side flanges of the panels closely adjacent one another so that the webs of the panels form a substantially continuous surface.

13 Claims, 3 Drawing Sheets

MINE VENTILATION STRUCTURE

This is a continuation of application Ser. No. 07/706,036, filed May 28, 1991 abandoned.

BACKGROUND OF THE INVENTION

This invention relates generally to mine ventilation structures and more particularly to a mine ventilation structure used at the intersection of two mine passageways to prevent mixture of ventilation air in the two passageways.

A mine ventilation structure of the type to which the present invention generally relates can be either an "overcast" or an "undercast" mine ventilation structure. Overcast and undercast mine ventilation structures are widely used in underground mining to prevent the mixture of forced (or induced) ventilation air flowing through a first mine passageway with forced (or induced) ventilation air flowing through a second mine passageway at the intersection of those passageways. An overcast ventilation structure is a tunnel erected in the first passageway and extending through its intersection with the second passageway. The tunnel blocks communication of air between the first passageway and the second passageway at the intersection, but permits air in the second passageway to travel through the intersection in a passage created by a space between the roof of the tunnel and the mine passageway ceiling. An undercast is of similar construction, except that the air in the second passageway passes under the erected tunnel in a slot cut in the floor of the mine passageways at the intersection.

Mine ventilation structures are presently constructed in several different ways. A commonly used overcast ventilation structure includes side walls made of concrete blocks. Rails or I-beams bridging between the side walls at locations spaced longitudinally of the side walls form the superstructure for the roof of the overcast. The spaces between the rails or beams are filled in with, typically, corrugated steel panels or flat concrete blocks so that the a deck may be formed on the roof superstructure. Overcast ventilation structures may also be formed from tunnel liners, that is, structures which were intended to support the walls of the mine passageway. Tunnel liners are usually steel arches with heavy wood lagging, or steel plates that can be pinned or bolted together to form an archway to form the overcast tunnel. The use of a tunnel liner as a ventilation structure departs from its intended use. Both types of overcast structures described require several persons and large quantities of material to construct.

Another type of mine ventilation structure to which the present invention particularly relates has side walls formed from telescoping steel panels of the kind used for mine stopping described in co-assigned U.S. Pat. No. 4,483,642, which is incorporated herein by reference. A deck of the tunnel (constituting either the roof or the floor of the tunnel) is formed by relatively large, flat rectangular steel panels extending between the side walls. In an overcast ventilation structure, the panels are supported at the top of the side walls, while in an undercast ventilation structure, the panels are supported on either side of a slot cut in the mine floor. However, the panels cannot support their own weight and substantial loads over the span between the side walls or sides of the slot, and it is necessary that they be suspended by wires from the roof of the mine passageway. The installation of the wire supports requires skill on the part of the installers and consumes a significant portion of the total time taken to construct the ventilation structure. In addition, the wires may become loose if the mine walls shift and converge. When the ventilation structure is an undercast, the wires obstruct the path of travel through the tunnel, particularly machinery passing through the tunnel.

SUMMARY OF THE INVENTION

Among the several objects and features of the present invention may be noted the provision of a mine ventilation structure which prevents the mixture of air flows at the intersection of two mine passageways; the provision of such a ventilation structure which is made up of relatively lightweight component parts which can be easily transported into the mine for assembly; the provision of such a ventilation structure which can be quickly assembled and requires no special construction skills; the provision of such a ventilation structure which has a self supporting deck requiring no connection to the mine roof; the provision of such a ventilation structure in which the deck is smooth and free of obstructions; and the provision of such a ventilation structure which is economical to manufacture.

Generally, a mine ventilation structure constructed according to the principles of the present invention for installation at the intersection of first and second passageways in a mine defines a first passage communicating with the first passageway and a second passage communicating with the second passageway. The mine ventilation structure includes a pair of generally parallel, spaced-apart side walls defining the side walls of the first passage, and a plurality of elongate deck panels extending between the side walls and forming the roof of one of the first and second passages and the floor of the other of the first and second passages. Each deck panel comprises a sheet metal panel generally of inverted channel shape in transverse cross section having an upper web and side flanges extending down from the upper web at opposite sides of the web. The deck panels are adapted to be placed together in side-by-side relation with the side flanges of the panels closely adjacent one another so that the webs of the panels form a substantially continuous deck surface.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 2:
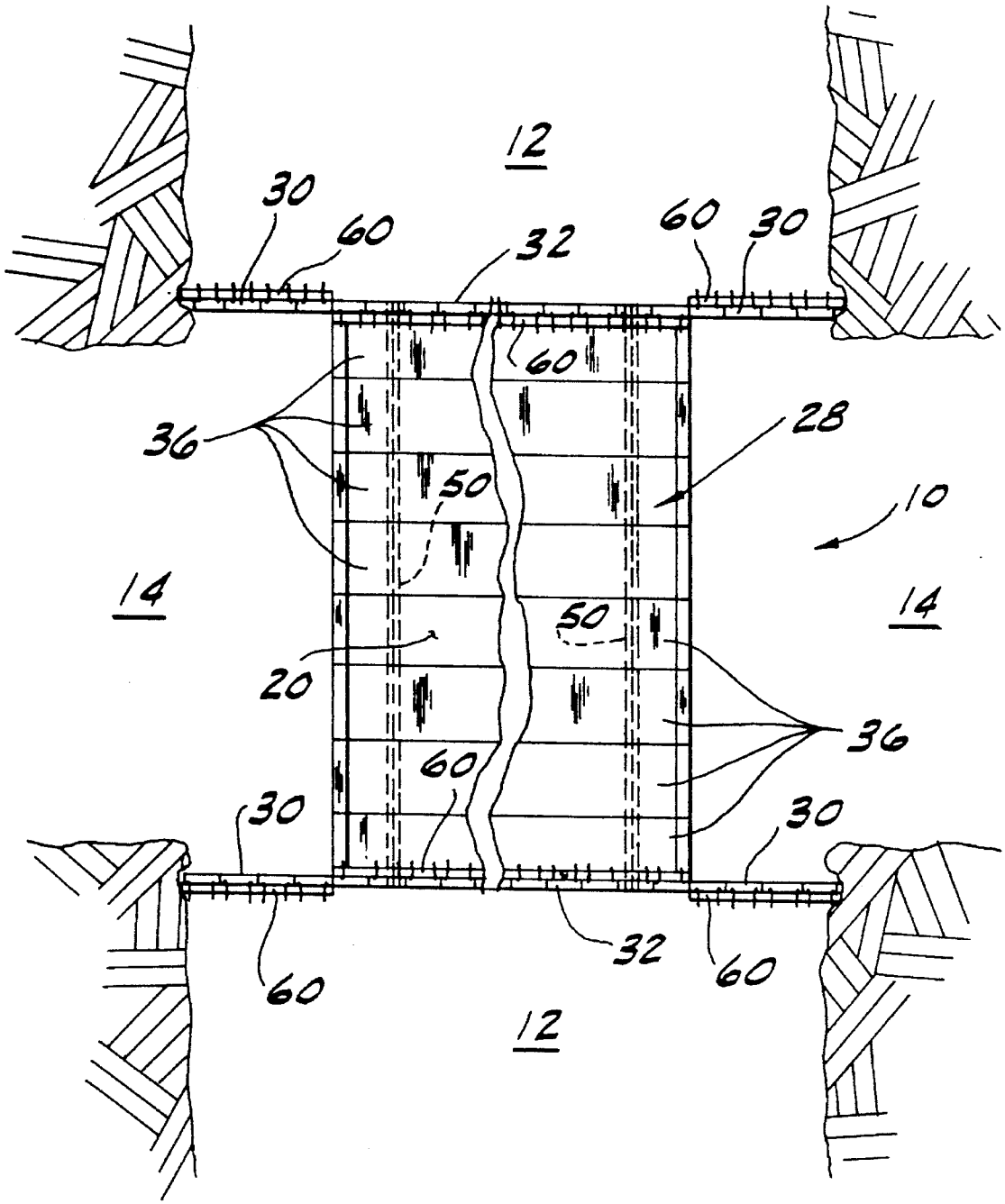
FIG. 2 is a top plan view of the overcast ventilation structure.

Referring now to the drawings, and in particular to the plan view of FIG. 2, a mine ventilation structure of the present invention, generally indicated at 10, is erected at an intersection of a first passageway 12 and a second passageway 14 in a mine to prevent the mixture of the air in the respective passageways. The mine ventilation structure 10 shown is an overcast which defines a first passage or "tunnel" 18 extending through the intersection and communicating with the first passageway 12 on either side of the intersection. The ventilation structure 10 allows air in the second passageway to flow through the intersection over the tunnel 18 in a second passage 20 defined by the space between the roof of the tunnel and the mine ceiling, but seals off communication between the first and second passageways 12, 14. The overcast ventilation structure 10 is made up of relatively lightweight component parts which may be transported into the mine for assembly in the intersection, as described more fully below. It is to be understood that although the preferred embodiment described herein is an overcast ventilation structure, the ventilation structure may be an undercast (i.e., of the type which allows air in the second passageway 14 to flow through the intersection under the tunnel 18) and still fall within the scope of the present invention.

Figure 1:
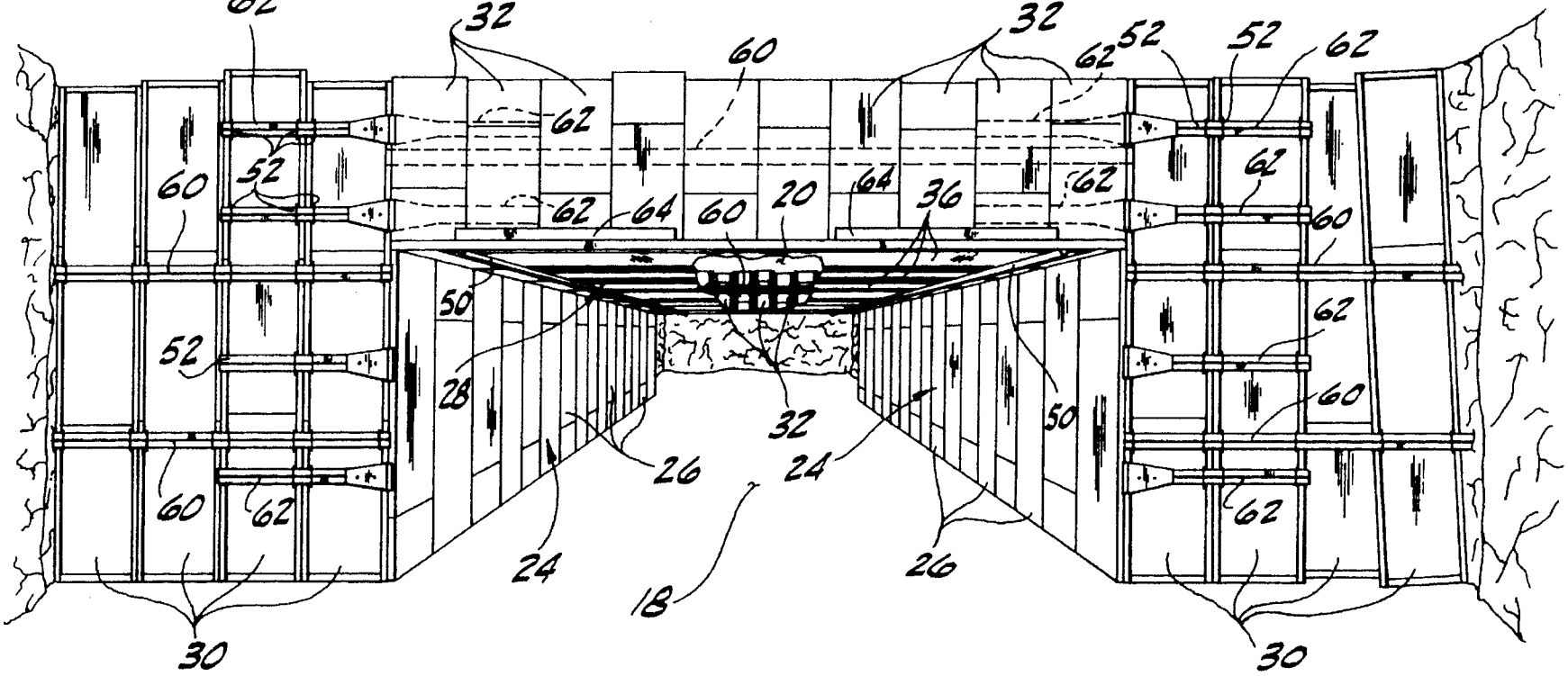
FIG. 1 is a front perspective view of an overcast mine ventilation structure constructed according to the principles of the present invention with parts broken away to show details.

As shown in FIG. 1, the overcast mine ventilation structure 10 includes a pair of generally parallel, spaced-apart walls extending upwardly from the floor of the mine and defining the side walls 24 of the tunnel 18. The side walls 24 are preferably made up of a plurality of elongate, vertically oriented sheet metal side wall panels 26 secured together in closely adjacent side-by-side relation. It is to be understood that the side walls may be constructed of other materials, such as concrete blocks, and still fall within the scope of the present invention. A deck indicated generally at 28 extending between the side walls forms the roof of the tunnel 18 and the floor of the second passage 20 over the tunnel. Wing panels 30 and end panels 32 located at each end of the tunnel 18 extend between the tunnel and the walls of the first passageway 12 to close off the tunnel and the first passageway from the second passageway 14. A portion of the deck 28 in FIG. 1 is broken away to show the end panels 32 at the far end of the tunnel 18 extending upwardly from the deck and engaging the mine ceiling. The end panels 32 and the wing panels 30 are of the type described in U.S. Pat. No. 4,483,642, which have telescoping sections that may be extended and retracted to selectively adjust the height of the panel according to the vertical dimension of the first passageway 12. It is to be understood that although the description of the preferred embodiment provides for steel ends and wings, they may be constructed of other suitable material (e.g. masonry units) or either or both may be omitted entirely by sizing the tunnel width to equal the mine entry width and/or the tunnel height to equal the mine entry height. In the latter case, the mine roof above the center of the tunnel must be removed to provide the necessary air passageway.

Figure 3:
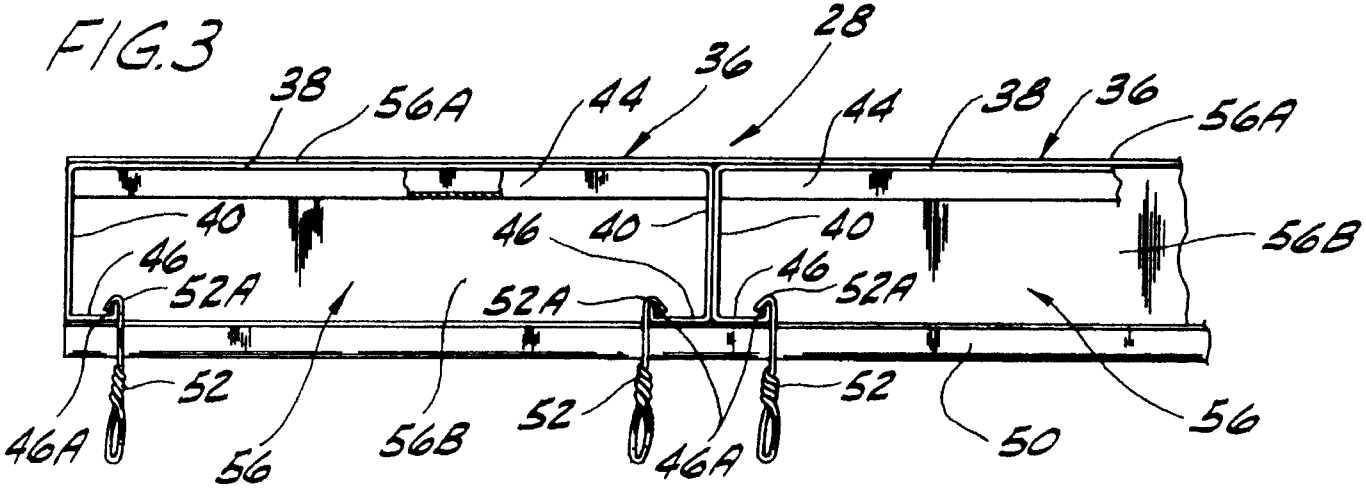
FIG. 3 is a fragmentary side elevation of a deck of the ventilation structure.

The deck 28 is formed from a plurality of elongate deck panels 36 each of which is supported between the side walls 24 of the tunnel 18 and bridges the space between the side walls. In the preferred embodiment, the deck panels 36 are not secured to the side walls 24 with fasteners, but are held on the side walls by their own weight and the loads they support. However, a ventilation structure having deck panels secured with fasteners is contemplated by the present invention. In addition, the deck panels 36 may also be secured to the side walls 24 by inverted channels (not shown) attached to the deck panels at their ends and extending transversely of the deck panels. The channels are sufficiently wide to receive an upper portion of the side walls 24 in them for interconnecting the deck panels 36 with the side walls. As shown in FIG. 3, each deck panel 36 comprises a sheet metal panel generally of inverted channel shape in transverse cross section having an upper web 38 and side flanges 40 extending down from the upper web at opposite sides of the web. The deck panels 36 of the present invention support their own weight, as well as the load caused by persons traveling across the deck 28 in the second passage 20, debris falling down onto the deck from the mine ceiling and, in the case of an undercast ventilation structure, machinery, passing through the intersection on the deck. To strengthen the web 38, as may be seen in FIGS. 3 and 4, angle irons 44 (broadly "reinforcing members") extending transversely of the deck panels 36 between the side flanges 40 and are attached as by welding to the underside of the web 38 of the deck panels at locations spaced longitudinally of the deck panels. The side flanges 40 are stiffened by inwardly turned lips 46 at the bottoms of the side flanges 40 extending the length of the side flanges. The free edge of each lip 46 is turned upwardly as indicated at 46A.

The deck panels 36 of the present invention are sufficiently strong to support their own weight and any loads placed on them without being supported from the mine ceiling by suspension wires. The web 38 of the deck panel of this embodiment is 24 inches in width and the side flanges 40 are 4 inches wide. Although these dimensions give the deck panel 36 adequate strength for most applications, these dimensions can be altered as necessary depending upon the length of deck panel required and the loads which must be supported. Because the deck panels 36 can be placed together in closely adjacent relationship so that their webs 38 form a substantially continuous surface and because they do not require suspension wires, the deck formed by the panels is smooth and free of obstructions, which facilitates travel across the deck and clearing the deck of debris which falls onto it from the mine ceiling.

Means, constituting in this embodiment tie bars 50, is provided to secure the deck panels 36 together in closely adjacent relation so that the deck 28 functions as a unitary rigid structure which will not leak air and which will better support the lateral component (i.e., the component transverse to the deck panels) of any load. As shown in FIG. 3, the tie bars 50 extend transversely of the deck panels 36 below the side flanges 40 and are rigidly and releasably secured to the deck panels by wire ties 52. The wire ties 52 are generally U-shaped and have hooks 52A at each of their free ends adapted to extend over the upturned free edges 46A of the lips of adjacent deck panels. A central portion of the wire ties can be twisted as shown in the drawings to deform the wire ties 52 tightly around the tie bars 50 for securely attaching the tie bars to the side flanges 40. Thus it may be seen that the deck panels 36 are secured together quickly and easily without the use of ordinary fasteners such a nuts and bolts which take considerably longer to secure.

Figure 4:
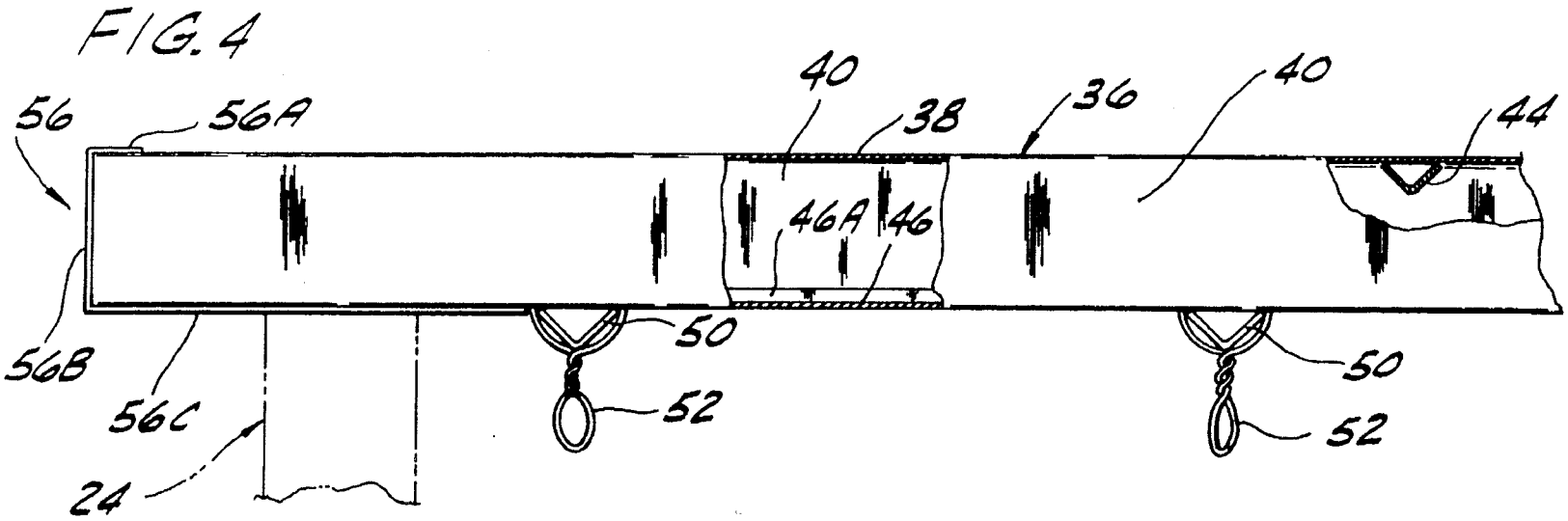
FIG. 4 is a fragmentary front elevation of a deck panel with parts broken away to show details.

The open ends of the deck panels 36, which overlie the side walls 24 of the tunnel 18, are closed by end caps, generally indicated at 56, affixed to the deck panels (as by welding) to inhibit the exchange of air between the tunnel and the second passage 20 thereabove. The end caps are sheet metal members having an upper portion 56A adapted to overlie the web 38 of a respective deck panel (FIG. 4). A side portion 56B of the end cap extends down from the upper portion 56A and closes the open end of the deck panel 36, and a lower portion 56C underlying the side flanges 40 of the deck panel 36 extends laterally from the side portion 56B and overlies the top of a respective side wall 24. The lower portion 56C extends a substantial distance under the deck panel 36 and provides a relatively broad, flat surface for engaging the side walls 24 to inhibit the exchange of air between the tunnel 18 and the second passageway 14 even when the deck panel extends outwardly a considerable distance beyond the side wall. In addition, the lower portions 56C of the end caps 56 strengthen the deck panel 36 at its ends.

The overcast ventilation structure 10 of the present invention may be erected quickly by only a few laborers who need no special knowledge of overcast construction. By way of example, the structure 10 may be erected by first positioning two wing panels 30 in the first passageway 12 adjacent the intersection at locations spaced laterally of each other. The space between the wing panels 30 will become the entrance to the overcast tunnel 18. The telescoping wing panel sections may be extended by means of a jack (not shown) in the manner described in U.S. Pat. No. 4,483,642 until they are tightly held between the ceiling and floor of the first passageway 12. The wing panels 30 seal at their upper ends against the ceiling of the first passageway 12 by the engagement of a head seal (not shown) in the end of the upper wing panel section with the ceiling of the first passageway. The head seal may be of the type described in U.S. Pat. No. 4,820,081, which is incorporated herein by reference. Two holes are cut in each side wall of the first passageway 12 for receiving one end of rib angle irons 60 which are secured to the wing panels 30 by wire ties 52 and hold the wing panel sections in their extended positions.

Corresponding sections of side wall panels 26 are then erected to form portions of the side walls 24 of the overcast tunnel 18. The side wall panels 26 also include telescoping sections which are extended to a desired height less than the height of the mine passageways and secured in extended position in closely adjacent side-by-side relation by rib angles 60 and wire ties 52 in the manner of the wing panels 30. The side wall panels 26 and the wing panels 30 are connected by hinge connectors 62 secured to the wing panels and side wall panels by wire ties 52. The remaining wing panels 30 needed to fill in the space between each of the two wing panels already erected and the side walls of the first passageway 12 are then erected and secured to the rib angles 60. If necessary, the wing panels 30 may be overlapped, as shown on the right side of the passageway in FIG. 1, to fill in the remaining space between the originally erected wing panels and the side walls of the first passageway. The side walls 24 of the tunnel 18 may then be completed by erecting further side wall panels 26 in the manner described above.

The deck 28 is formed by bridging the deck panels 36 between the side walls 24 of the tunnel 18. The deck panels 36 are secured together by the tie bars 50 extending transversely of the deck panels (lengthwise of the tunnel 18) and attached to the deck panels by wire ties 52. The wing panels 30 at the opposite end of the tunnel 18 are erected in the same way as the wing panels at the near end of the tunnel. The end panels 32 are installed at each end of the tunnel 18 by extending the telescoping sections of the end panels to fill in the space between the deck 28 and the mine ceiling. The end panels 32 may include the same head seals (not shown) as the wing panels 30 for sealing with the ceiling of the mine. Prior to placing the end panels 32 in position, end panel retainer channels 64 are attached to the deck 28 to locate the bottom edge of the end panels. The end panels sections are held in their extended positions by a rib angle 60 (shown in hidden lines in FIG. 1) secured by wire ties (not shown) to the end panels 32. The end panels 32 are connected to the wing panels 30 by hinge connectors 62 secured to the end panels and wing panels by wire ties 52. The use of wire ties 52 to connect the various components of the overcast structure 10 greatly facilitates breaking down the overcast without damage to the structure so that it can subsequently be used at a different location.

The end, wing, and side wall panels (32, 30, 26) are typically made of 20 guage sheet metal and the deck panels are typically made of 14 guage sheet metal. However, it is to be understood that the sheet metal may be of other gauges and still fall within the scope of the present invention. Moreover, the end, wing and side wall panels (32, 30, 26), which are made of steel, may be replaced with walls constructed from other materials such as concrete blocks, and still fall within the scope of the present invention.

Once the ventilation structure 10 has been erected, it must be sealed at the joints between the abutting wing, side and deck panels, and between the wing panels 30 and the side walls of the first passageway 12. Sealing may be carried out by applying a suitable plaster, such as MP-568 sold by Jack Kennedy Metal Products & Buildings, Inc. of Taylorville, Ill., or a tape, such as MP-569, also sold by Jack Kennedy Metal Products & Buildings, Inc., to the various joints. Once the sealing process is completed an airtight separation of the first and second passageways 12, 14 is achieved at the intersection.

It is to be understood that the same basic principles of construction apply when the ventilation structure is to be an undercast. However, in that event, the deck panels 36 will form the floor of at least part of the tunnel 18 and the roof of the second passage. Moreover, construction of the undercast ventilation structure will require cutting a trench (not shown) in the floor of the mine passageways at the intersection to form the bottom and side walls of the second passage which will extend under the tunnel. The deck panels 36 are bridged over the trench, with a space being left uncovered at the ends of the trench to admit air into the trench.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mine ventilation structure for installation at the intersection of first and second passageways in a mine, said ventilation structure defining a first passage communicating with said first passageway and a second passage communicating with said second passageway, said ventilation structure comprising, a pair of generally parallel, spaced-apart side walls defining the side walls of said first passage, a plurality of elongate unitary deck panels extending between the side walls and forming the roof of one of said first and second passages and the floor of the other of said first and second passages, each deck panel spanning the full distance between the side walls and being constructed to support its own weight, the weight of accumulated debris from the mine ceiling and the weight of mine personnel, each unitary deck panel being formed as a one-piece sheet metal panel generally of inverted channel shape in transverse cross section to have a generally planar upper web and side flanges extending down from the upper web at opposite sides of the web, the deck panels being adapted to be placed on the side walls in a side-by-side relation with the side flanges of the panels closely adjacent one another so that the webs of the panels form a substantially continuous planar surface, the deck panels so placed being capable of independently supporting their own weight, the weight of accumulated debris from the mine ceiling and the weight of mine personnel.

2. A mine ventilation structure as set forth in claim 1 wherein the side flanges of each deck panel having inwardly turned lips at their lower ends extending longitudinally of the panel, the upper web, side flanges and lips of each deck panel being formed as one piece.

3. A mine ventilation structure as set forth in claim 1 further comprising reinforcing members on the underside of the web of each deck panel extending generally transversely of the deck panel between the side flanges of the panel.

4. A mine ventilation structure as set forth in claim 1 further comprising means for holding the deck panels together in fixed side-by-side relation, said deck panel holding means comprising a plurality of tie bars extending generally transversely of the deck panels below the side flanges thereof, and means for rigidly and releasably securing the tie bars to the side flanges.

5. A mine ventilation structure as set forth in claim 4 wherein the side flanges of each deck panel have inwardly turned lips at their lower ends extending longitudinally of the panel, and wherein said securing means comprises a plurality of generally U-shaped wire ties for securing the tie bars to the deck panels, each tie having a hook at each end adapted to extend over the edge of the lip of one of the deck panel side flanges, and a central portion adapted to be twisted so as to deform the tie around the tie bar to hold secure the tie bar to the side flange.

6. A mine ventilation structure for installation at the intersection of first and second passageways in a mine, said ventilation structure defining a first passage communicating with said first passageway and a second passage communicating with said second passageway, said ventilation structure comprising, a pair of generally parallel, spaced-apart side walls defining the side walls of said first passage, a plurality of elongate unitary deck panels extending between the side walls and forming the roof of one of said first and second passages and the floor of the other of said first and second passages, each deck panel spanning the full distance between the side walls and being constructed to support its own weight, the weight of accumulated debris from the mine ceiling and the weight of mine personnel, each unitary deck panel being formed as a one-piece sheet metal panel generally of inverted channel shape in transverse cross section to have a generally planar upper web and side flanges extending down from the upper web at opposite sides of the web, end caps located at the ends of each deck panel for providing a substantially airtight closure of the ends of the deck panels to inhibit exchange of air between the first and second passages, the deck panels being adapted to be placed on the side walls in a side-by-side relation with the side flanges of the panels closely adjacent one another so that the webs of the panels form a substantially continuous planar surface, the deck panels so placed being capable of independently supporting their own weight, the weight of accumulated debris from the mine ceiling and the weight of mine personnel.

7. A mine ventilation structure as set forth in claim 6 wherein each end cap comprises a sheet metal member having an upper portion adapted to overlie the web of a respective deck panel, a side portion extending down from the upper portion for closing an open end of the deck panel, and a lower portion underlying the side flanges of the deck panel.

8. A mine ventilation structure as set forth in claim 7 wherein the lower portion of the end cap extends laterally from the side portion and overlies the top of a respective side wall.

9. A mine ventilation structure as set forth in claim 1 wherein each side wall is formed by a plurality of sheet metal side wall panels secured together in substantially vertical side-by-side relation.

10. A mine ventilation structure as set forth in claim 9 wherein each side wall panel is a telescoping panel adjustable for varying the height of the panel.

11. A mine ventilation structure as set forth in claim 2 wherein the inwardly turned lips have upwardly turned free edges extending the length of the lips for strengthening the panel.

12. A mine ventilation structure for installation at the intersection of first and second passageways in a mine, said ventilation structure defining a first passage communicating with said first passageway and a second passage communicating with said second passageway, said ventilation structure comprising, a pair of generally parallel, spaced-apart side walls defining the side walls of said first passage, a plurality of elongate deck panels extending between the side walls and forming the roof of one of said first and second passages and the floor of the other of said first and second passages, each deck panel spanning the full distance between the side walls and being constructed to support its own weight, the weight of accumulated debris from the mine ceiling and the weight of mine personnel, each deck panel comprising a sheet metal panel generally of inverted channel shape in transverse cross section to have an upper web and side flanges extending down from the upper web at opposite sides of the web, end caps located at the ends of each deck panel for providing an airtight closure of the ends of the panel to inhibit exchange of air between the first and second passages, the deck panels being adapted to be placed on the side walls in a side-by-side relation with the side flanges of the panels closely adjacent one another so that the webs of the panels form a substantially continuous surface.

13. A mine ventilation structure as set forth in claim 12 wherein each end cap comprises a sheet metal member having an upper portion adapted to overlie the web of a respective deck panel, a side portion extending down from the upper portion for closing an open end of the deck panel, and a lower portion underlying the side flanges of the deck panel.

* * * * *